United States Patent [19]

Winchester

[11] Patent Number: 4,879,438

[45] Date of Patent: Nov. 7, 1989

[54] LOCK-ON/LOCK-OFF SWITCH FOR POWER TOOL

[75] Inventor: Charles D. Winchester, Easley, S.C.

[73] Assignee: Ryobi Motor Products Corp., Pickens, S.C.

[21] Appl. No.: 226,578

[22] Filed: Aug. 1, 1988

[51] Int. Cl.[4] ..... H01H 9/06

[52] U.S. Cl. ..... 200/61.85; 200/505; 310/50

[58] Field of Search ..... 200/61.85, 293.1, 332, 200/332.1, 332.2, 334, 505; 310/47, 50

[56] References Cited

U.S. PATENT DOCUMENTS 4,192,982 3/1980 Schnizler, Jr. et al. ..... 200/61.85

4,376,240 3/1983 Stuart ..... 200/334

*Primary Examiner*—A. D. Pellinen

*Assistant Examiner*—Morris Ginsburg

*Attorney, Agent, or Firm*—David L. Davis

[57] ABSTRACT

A powered tool controlled by an actuating lever is provided with a simplified structure combining lock-off and lock-on functions. A trigger is mounted on the actuating lever and is pivoted about an axis parallel to a pivot axis for the actuating lever. The trigger is displaceable in a direction substantially parallel to the direction of displacement of the actuating lever, reducing the dexterity required of an operator to permit operation of the actuating lever. A hooked lever element extends from the trigger and a blocking device, which may be a post or a ribbed structure, projects from the tool housing. The hooked lever and blocking device cooperate to (1) abut, to prevent actuation of the motor unless the trigger is first operated, and (2) lock the actuating lever in an operated state upon subsequent release of the trigger.

19 Claims, 2 Drawing Sheets

LOCK-ON/LOCK-OFF SWITCH FOR POWER TOOL

FIELD OF THE INVENTION

This invention relates to controls for motor driven tools, and more specifically to safety control switches, including both a lock-off structure for preventing accidental activation of the motor and a lock-on structure, or latch, for latching the motor in a locked-on, or activated, state.

BACKGROUND ART

The use of electrical motors to drive tools is well known and widely practiced. Thus, there is commercially available a wide variety of power driven tools, for commercial as well as hobbyist application, for use in construction, shop, and landscaping or gardening applications. For example, it is known to provide electrically driven motors for operating drills, saws, sanders, grinders, hedge trimmers, mowers, and the like. However, it is also known that some electrically operated tools may be hazardous if inadvertently activated. Thus, it is appreciated in the art that safety control switches are necessary to avoid unintended operation of such tools.

It is also appreciated in the art that control switches for electrical motors used to drive various tools may be designed to require coincident operation of a pair of mechanical elements to activate the motor to drive the tool. Such an approach is based on the theory that the likelihood of accidental activation of a tool is minimized by requiring the simultaneous occurrence of two deliberate, intentional, operations. It is contemplated that an accidental event, such as dropping or bumping of the tool, may cause the inadvertent and unintended occurrence of one such operation. However, the likelihood of occurrence of a plurality of required operations, as necessary for activation of such safety control devices, is reduced since a single accidental occurrence is not likely to cause two switch devices to be operated, and particularly to be operated substantially simultaneously.

Yet another aspect of operation of electrical switches for controlling motor driven tools relates to fatigue of the operator in maintaining a tool constantly in an active, or operated, state. That is, on occasion it may be required to operate a tool in a continuously-on state, for lengthy time periods. When an operator is required to exert physical pressure or force against a switch member for a protracted period of time in order to maintain the tool in the continuously-on state, operator fatigue may occur which may result in an unintended deactivation of the motor or, in a worst case situation, may result in hazardous operation of the tool.

Accordingly, it is also known in the art to provide latching mechanisms for locking the tool control switches in a constantly activated condition.

However, various prior art safety and locking devices are cumbersome and require great dexterity on the part of an operator in order to activate or to lock-on the switches. For example, in several such switches it is known to provide a controlling switch on one side of the tool and a separate safety switch on the other side of the tool, and to permit initial operation or locking operation of the switch only when the safety switch is simultaneously operated on the opposite side of the tool. For large tools, such operation may add to the difficulties of operators having small hand-spans, for example.

In another prior art approach, it is known to provide a latch, cooperating with the tool control switch. However, in order to operate the tool or to lock the tool in an active, operated state, the control switch must be depressed in one direction and the latch must be displaced in a direction perpendicular thereto. Again, increased dexterity is required of an operator in order to activate such a safety arrangement.

While these and other prior art approaches do, indeed, perform the function of reducing the likelihood of inadvertent operation of the tool, such prior art approaches also hamper the smooth and unobstructed operation of the tool by an operator.

Still other prior art approaches are known for providing a locking-on function for a tool activating switch. Where a separate button needs to be activated or depressed, simultaneously with operation of a trigger, in order to lock operation in a "constant-on" state, problems similar to those described hereinabove result.

Moreover, the various devices used in the prior art to attain the above-identified functions are needlessly complex and susceptible to failure.

DISCLOSURE OF INVENTION

It is accordingly a primary object of the present invention to overcome the difficulties of the prior art and to provide apparatus which, while reducing the likelihood of inadvertent activation of a motor driven tool, is simple to operate and does not require added dexterity by an operator.

It is yet another object of the present invention to combine such a simply operated device, which provides a lock-off function, with an easily operated device providing a lock-on function.

Still another object of the invention is the provision of a lock-off and lock-on operating switch for a motor driven tool which does not require application of forces at different locations.

It is a further object of the invention to provide a lock-off and lock-on tool activating switch wherein both functions are activated by application of a force in substantially the same direction as the force applied to a trigger in order to activate the tool.

A more detailed object of the invention is to provide an arrangement for activating an electrical motor to drive a tool, including an actuator lever, for operating a switch armature, and for providing a separate trigger, operable by forces which are substantially coplanar with and parallel to forces used to activate the actuator lever, together with an assembly preventing operation of the actuator without simultaneous activation of the trigger.

It is still a further object of the invention to provide a trigger on a lever actuator for a power tool, wherein the trigger is required to be activated in order to permit the actuator to be operated, and further permitting the same trigger to be used to lock-on the tool after appropriate operation of the power actuator lever.

Yet another object of the invention is the provision of a simplified mechanism for preventing operation of a power actuator and for locking-on a motor tool operated by such an actuator, wherein the mechanism includes a ribbed structure and a lever structure cooperating therewith.

Still another object of the invention is the provision of a simplified mechanism for preventing operation of a power actuator and for locking-on a motor tool operated by such an actuator, wherein the mechanism includes a post-and-hooked-lever structure.

It is a more detailed object of the invention to provide a simplified mechanism for locking-on and locking-off a motor, including a trigger, operated in substantially the same direction as an actuating lever for the motor, the trigger including a lever extending therefrom and cooperating with a mating structure projecting from the tool housing, the lever normally biased to present an abutting surface to the projecting structure thus preventing operation of the power actuating lever and, upon displacement of the trigger, operable for withdrawing the abutting surface from the projecting structure to permit operation of the power actuating lever.

Still a further object of the invention is the provision of a lever on a trigger portion on a power actuator, including a hooking portion of the lever for engaging the projecting structure upon release of the trigger, thus providing a locked-on operation.

It is another object of the invention to provide the above described simplified mechanism wherein the mating structure projecting from the tool housing is an easily made structure extending from the housing, which may take the form of a rib or a post, for example.

In accordance with the invention, there is thus provided an improvement for a switching apparatus arranged for activating a driving motor of a motor driven device. The switching apparatus generally includes a switch for closing and breaking an electrical path to provide and remove electric current to and from the motor, respectively; a manually operable power actuating lever for actuating an armature of the switch; and a locking structure for preventing operation of the actuating lever to actuate the armature of the switch, and thereby to prevent the actuating lever from closing the electrical path. The inventive improvement particularly includes a control device, used for controlling operation of the locking structure, and a mounting arrangement for mounting the control device to the actuating lever. The control device is specifically operable for constraining movement of the locking structure to be in a direction substantially parallel to the direction of movement of the actuating lever.

Preferably, the mounting arrangement includes a pivot for pivoting the control device about an axis substantially perpendicular to an operator engageable edge of the actuating lever. Further, the control device includes a trigger engageable by a finger of the operator while engaging the lever to actuate the switch.

Towards that end, the trigger includes an edge surface which is curved to match a contour of a finger, thereby to facilitate engagement thereof by the operator's finger.

The device operated by the switching apparatus is mounted on a housing, which includes a blocking component. The trigger includes a cooperating component, cooperating with the blocking component by including an abutment surface for abutting against the blocking component, thereby to block movement of the actuating lever to prevent actuation of the armature of the switch.

More particularly, the blocking component includes a ribbed structure extending from the housing, while the cooperating component includes an abutment element extending from the trigger, one surface of the element including the abutment surface. In an alternative embodiment, the blocking component includes a post extending from the housing and cooperating with the element extending from the trigger. Additionally, there is included a biasing device for biasing the element extending from the trigger to a position engaging the cooperating component, wherein the abutment element abuts against the post, thus blocking the actuating lever from actuating the armature of the switch. The biasing device may include a spring.

Additionally, a second surface of the element includes a hook for latching engagement with either the ribbed structure or the post, thereby retaining the actuating lever in latched actuation of the armature to provide electric current to the motor for driving the device.

In accordance with a different aspect of the invention, there is provided an improvement for a switching apparatus for a driving motor of a motor driven device. The switching apparatus includes a switch for closing and breaking of an electrical path to provide and remove electric current to and from the motor, respectively, and a manually operable power actuating lever, displaceable along a predetermined path to actuate an armature of the switch, thereby to provide and remove the electric current. The improvement includes: a trigger, displaceable upon operation by an operator along a path substantially parallel to the path of the actuating lever; a locking structure, for conditioning operation of the actuating lever on operation of the trigger; and a latch, for latching the actuating lever in a locked-on state wherein the armature of the switch is actuated to provide electric current to the motor independently of application of further force by an operator.

The actuating lever is rotatably mounted for rotation about a first pivot axis, and the trigger may be pivoted for rotation, about a second pivot axis substantially parallel to the first pivot axis and may be mounted on the actuating lever.

Preferably, the latch includes a hook-and-retainer assembly including a hook and a retainer. One of the hook and the retainer is mounted fixedly relative to the armature of the switch, while the other is mounted on the actuating lever. The one of the hook and the retainer is mounted at a location wherein the actuating lever, when latched by the latch, operates the armature of the switch.

In accordance with the invention, the hook is mounted on the trigger and the retainer includes a post or a ribbed structure extending from a housing for the switch.

The locking structure of the improvement includes abutting surfaces of the hook and the retainer, cooperatively engaging one another to prevent movement of the actuating lever, thereby preventing operation of the armature of the switch, until operation of the trigger.

Preferably, the hook includes a lever extending from the trigger, the trigger being pivotable about a pivot axis for displacing the hook from abutment against the retainer to permit operation of the actuating lever for actuating the armature of the switch. The retainer, as previously described, may include a post extending from a housing for the switch, the post being positioned for abutment against the lever.

In such an arrangement, the lever extending from the trigger is dimensioned for preventing actuation of the armature by the actuating lever when abutting against the post and for positioning the actuating lever to actuate the armature when latching the post. Thus, the extending lever locks the motor driven device in an off state when the actuating lever is operated unless the trigger is operated. Operation of the device is permitted only when both the actuating lever and the trigger are operated. The lever arrangement provides a latched operation of the device (in an on state) when the trigger is released prior to release of the actuating lever, and provides for de-activation of the armature by operating the trigger to unlatch the lever from the post.

These and other objects, features and advantages of the present invention will become apparent to those skilled in the art from the following description and drawings, wherein there is shown and described a preferred embodiment of the invention, simply by way of illustration and not of limitation. As will be realized upon examination of the specification and from practice of the same, the present invention is capable of still other, different, embodiments and its several details are capable of modifications in various obvious aspects, all without departing from the invention. Accordingly, the drawings and the descriptions provided herein are to be regarded as illustrative in nature and not as restrictive of the invention.

BRIEF DESCRIPTION OF THE DRAWINGS

In accordance with the above described objects and features of the invention, a preferred embodiment thereof is shown in the accompanying drawings, wherein.

BEST MODE FOR CARRYING OUT THE INVENTION

Figure 1:
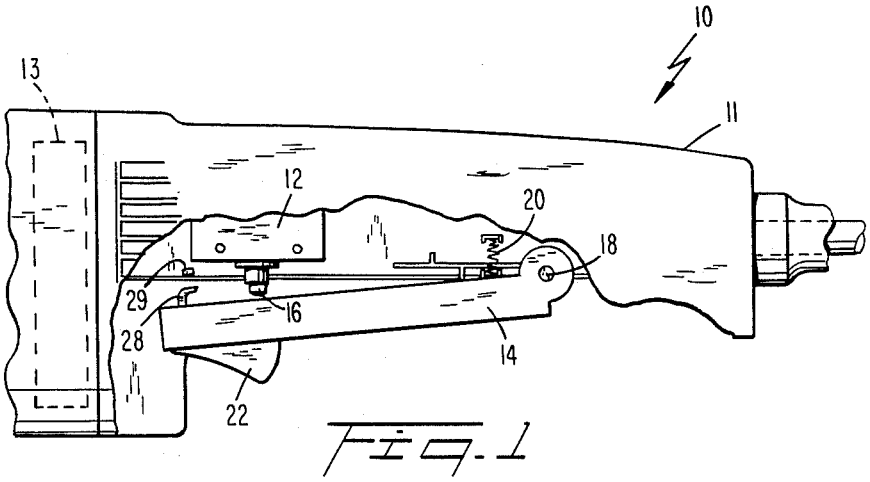
FIG. 1 shows a partial view of a handle portion of a powered tool.

Referring now to FIG. 1, there is generally illustrated at 10 a partial view of a portion of a handle 11 of a powered tool. Although the term "tool" is used herein, it should be appreciated that the inventive arrangement is applicable to any electrically powered device, having a manually operable control switch. Thus, it is particularly contemplated that the improvement of the invention is applicable to tools, such as grinders, drills, saws and the like, to landscaping devices, such as mowers, hedge trimmers and the like, and to domestic appliances, such as electrically operated knives, scissors and the like. However, the inventive concept may also be applied to other classes of electrically driven devices. The term "tool" is accordingly to be understood as a short-hand manner of reference to all such devices.

The illustrated handle portion generally includes therein a switch 12 for closing and opening an electrical circuit in order to control operation of a motor used to drive the powered tool. The motor is not part of the invention and is shown in dashed outline, identified by reference numeral 13. More particularly, there is provided a manually operated actuating lever 14, displaceable in a predetermined direction to engage and actuate an armature 16 of switch 12, thus to activate and deactivate the motor for controllably driving the tool.

It should be understood that lever 14 may engage an actuating rod of switch 12, wherein the actuating rod is internally connected within the switch to actuate the armature. Moreover, although direct contact is shown in the drawings for the actuating lever 14 and armature 16, there may be provided an intermediate contacting lever without departure from the scope of the invention. Thus, there may be provided an extension of the lever 14 for engaging the armature.

In the illustrative embodiment shown herein, the arrangement of actuating lever 14 includes a pivot 18, so that lever 14 pivots about an axis of the pivot. A biasing spring 20 biases actuating lever 14 to an inoperative position, wherein the tool is not being driven.

Although a rotatable mounting is provided for actuating lever 14, it should be understood that the lever may be slidably mounted within the tool handle, or within any other portion of the tool housing.

Also provided in the inventive arrangement is a trigger 22, for activating a locking structure preventing operation of the actuating lever 14, thus effectively locking the tool in an off condition. Trigger 22 additionally operates a latching arrangement, for latching actuating lever 14 in an on position, thus locking the tool in an on condition.

The illustrated structure further provides a lever element 28, extending from trigger 22, and a cooperating mating structure 29, projecting from a housing portion of the handle 11. Lever element 28 and the projecting mating structure 29 cooperate to provide the advantages of the invention as will be understood from the following description.

Figure 2:
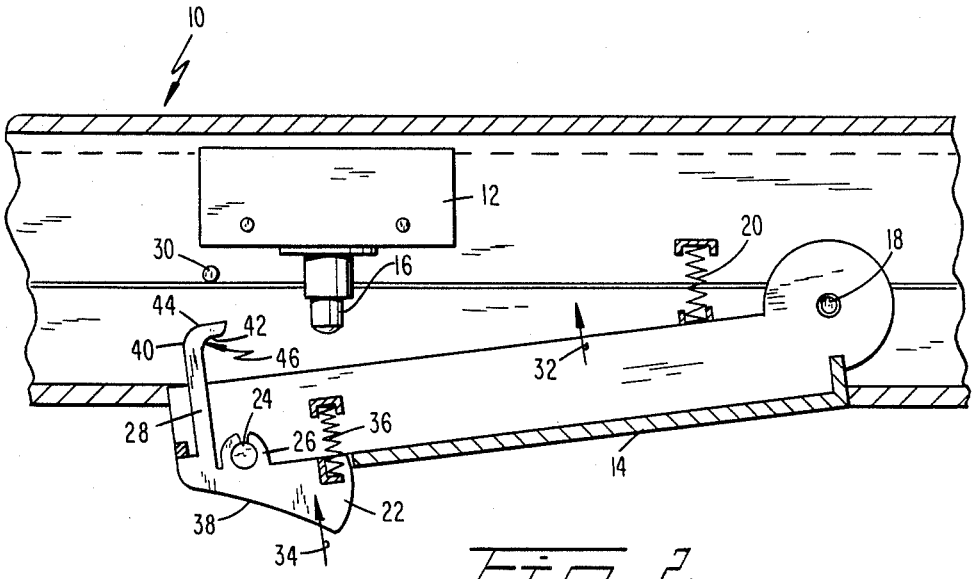
FIG. 2 shows a detailed view of one embodiment of the inventive structure, incorporating a post cooperating with the lever of FIG. 1.

Referring now to FIG. 2, where there is shown the structural configuration of the trigger 22 and the actuating lever 14, it is seen that trigger 22 is pivotally mounted on actuating lever 14. Thus, there is provided a mounting arrangement including a pivot 24, in the form of a post projecting perpendicularly from lever 14, and a rotatable portion 26 of trigger 22. Of course, the pivot post may project from the trigger and the surrounding rotatable portion, which may be in the form of a sleeve or opening, may be formed on the actuating lever 14.

In the embodiment of FIG. 2, the mating structure is provided in the form of a post 30, which extends from the tool housing and is fixed relatively to the switch 12. Lever element 28, which extends from trigger 22, is cooperatively operable with post 30. As is described in further detail hereinbelow, the lever element 28 and the post 30 cooperate to provide both the locking function and the latching function of the inventive arrangement.

An advantage of the present invention lies in the parallel nature of the two pivots used therein. Specifically, the axes of first pivot 18 and second pivot 24 are arranged to be parallel to one another in order to provide easy operation of trigger 22. Thus, in operation of actuating lever 14, the lever is displaced along a path generally indicated by an arrow 32. Similarly, in operation of trigger 22, the trigger is displaced along a path generally indicated by an arrow 34, substantially parallel to arrow 32. As seen in FIG. 2, a spring biasing device 36 biases trigger 22 to a predetermined position from which it may be displaced in the direction of arrow 34.

In view of the parallel arrangement of the pivots, the displacement paths of the lever and the trigger are thus substantially parallel to one another, permitting a simple and uncomplicated operation of trigger 22 to permit operation of lever 14 or to latch the lever.

It should be appreciated, however, that trigger 22 may be mounted onto the tool housing in the vicinity of the actuating lever 14, rather than on the actuating lever itself, without departing from the inventive concept. Moreover, the mounting arrangement may use a sliding structure, rather than a pivoted structure, to provide the substantially parallel displacement of the trigger and the lever, similarly without departing from the invention.

Moreover, in order further to simplify operation of trigger 22, the trigger is shown with a curved surface 38, providing a contour substantially matched to the contour of an operator's finger. While actuating lever is not shown as including such a curvature, it should be appreciated that a similar curvature may be provided therein. Particularly, the curvature which may be provided to the actuating lever may have a number of curved portions, to provide a convenient placement guide for a plurality of fingers of the operator.

As seen in FIG. 2, the lever element 28 extending from trigger 22 includes a first surface 40 and a second surface 42. The first surface 40 includes an abutment surface 44, cooperating with post 30 of the blocking component in an abutting relationship to prevent sufficient movement of actuating lever 14 along path 32 as to operate armature 16 of switch 12. Thus, in its normal status, the tool device is effectively locked off, and even attempted operation of the actuating lever 14 will not turn on the tool driving motor.

However, by operating trigger 22 to pivot about pivot 24, abutment surface 44 of lever element 28 is displaced from a position of abutting against post 30. Thus, when trigger 22 is operated, lever 14 is not blocked and may be displaced fully, thereby actuating the switch armature, closing the electrical circuit and providing current to turn on the driving motor of the tool. Accordingly, the present invention conditions operation of actuating lever 14, and thus of the power driven tool, on prior (or simultaneous) activation of the trigger 22.

Figure 3:
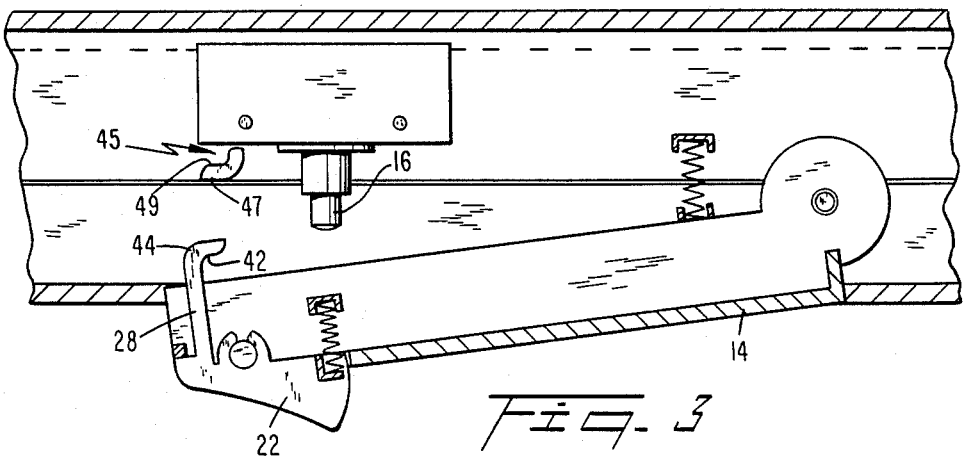
FIG. 3 shows a structural configuration of a trigger, an actuating lever and a ribbed structure, in an alternate embodiment of the invention shown in an unoperated condition.

Referring now to FIG. 3, there is shown a structural configuration of trigger 22, actuating lever 28 projecting therefrom, and a ribbed structure 45 corresponding to the mating structure 29, in an alternate embodiment of the invention (also shown in an unoperated condition). As will be appreciated from FIG. 3, the ribbed structure projects from the housing structure for the handle 11. A bottom surface of the ribbed structure, shown at 47, is angled relative to the horizontal to provide mating engagement with the abutment surface 44 of actuating lever 28. Thus, angling of bottom surface 47 provides a more secure engagement between the ribbed structure 45 and the lever 28 than is available without the angled surface, inasmuch as any contact force between the two components is more uniformly distributed, over a larger contact area than is otherwise available. This structure similarly provides a more uniform force distribution than is provided by the post structure 30 of the embodiment of FIG. 2. Accordingly, the more secure engagement provided between the two components provides a more secure lock-off mode of operation of the actuating lever 14.

Moreover, the upper surface 49 of the ribbed structure 45 may have a similar mating orientation, in order to provide a more secure lock-on mode of operation under considerations similar to those hereinabove set forth.

Figure 4:
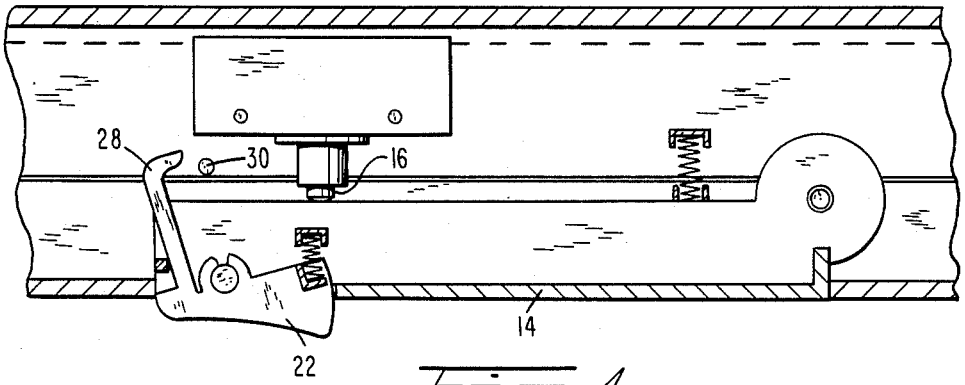
FIG. 4 shows the embodiment of FIG. 2 wherein the trigger is in an operated condition and the actuating lever is displaced to actuate a switch.

FIG. 4 shows the embodiment of FIG. 2, wherein trigger 22 is in an operated condition and actuating lever 14 is displaced to actuate switch 12. As shown therein, upon operation of the trigger 22 lever 14 may be displaced to turn on the driven tool device. From the illustration shown in FIG. 4, however, another advantage of the invention is explained as follows. As is seen in FIGS. 2 and 4, a hooked portion 46 is provided in the second surface 42 of lever element 28 extending from the trigger. That is, an inverted "L" or "J" shape is provided to the locking structure of the lever element 28.

Accordingly, by releasing the trigger 22 once the actuating lever 14 has been operated and the motor driven by switch 12 has been activated, the hooked portion 46 of lever element 28 is caused to engage post 30 in a latched arrangement. The operator is then no longer required to continue application of force to lever 14 in order to continue activation of the motor.

Figure 5:
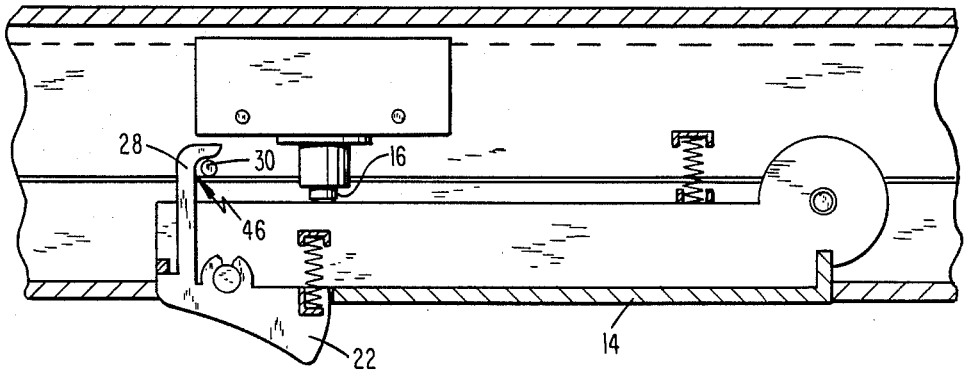
FIG. 5 shows the trigger of the embodiment of FIG. 2 in an operated condition, wherein the actuating lever is latched to the post in order to actuate the switch.

FIG. 5 shows the trigger 22 in an unoperated condition, wherein the lever element 28 is latched to post 30 to hold actuating lever 14 in order to maintain switch 12 in an activated condition.

As will be appreciated by those skilled in the art, post 30 and lever element 28 are placed at predetermined locations, and the dimensions of lever element 28 are predetermined to specifically designed values. The locations and dimensions are selected to assure that, when lever element 28 and post 30 are in abutment with one another, switch 12 has not been activated and, when hooked portion 46 of lever element 28 latches post 30, the switch 12 is, indeed, activated.

It will moreover be appreciated that the invention provides for a trigger activated structure which, on the one hand, blocks operation of the actuating lever and, on the other hand, latches the actuating lever. Thus, instead of providing a hooked structure and a post on the lever and the housing, respectively, other structural arrangements may be used to attain substantially the same results in substantially the same way. For example, the post portion may project perpendicularly from a non-hooked lever element extending from the trigger and a hooked portion may be provided on the housing.

Alternatively, other shapes may be used. For example, instead of a post or a ribbed structure as hereinabove described, there may be provided an eye structure for engaging the hook. Moreover, similarly to the embodiment of FIG. 3, a pair of inverted L-shaped or J-shaped structures may be used. Moreover, the specific location of the components may be varied, provided that one is fixed relatively to the switch and the other is movable by operation of a trigger, located within the immediate vicinity of the actuating lever and that the trigger moves in a path substantially parallel to the path of the actuating lever, thus providing a simplified and easily operated structure for both locking-off and locking-on operation of the tool.

The foregoing description of the preferred embodiment of the invention has been presented for purposes of illustration and description and is not intended to be exhaustive or to limit the invention to the precise forms disclosed, since many modifications and variations are possible in light of the above teaching. The embodiment was chosen and described in order best to explain the principles of the invention and its practical application, thereby to enable others skilled in the art best to utilize the invention in various embodiments and with various modifications as are suited to the particular use contemplated therefor. It is intended that the scope of the invention be defined by the claims appended hereto, when interpreted in accordance with the full breadth to which they are legally and equitably entitled.

I claim:

1. In a switching apparatus for activating a driving motor of a motor driven device to operate the device, said device being mounted on a housing, said housing comprising blocking means, the switching apparatus including a switch for selectively closing and breaking an electrical path to provide and remove electric current to and from the motor, respectively, a manually operable power actuating lever for actuating an armature of the switch, and locking means for preventing operation of the actuating lever to actuate the armature of the switch to close the electrical path, the improvement comprising:

control means for controlling operation of said locking means, said control means operable for constraining movement of said locking means to be in a direction substantially parallel to a direction of movement of said actuating lever, said control means comprising trigger means engageable by a finger of the operator while engaging said actuating lever to actuate the switch, said trigger means comprising cooperating means, said cooperating means comprising an abutment surface for abutting against said blocking means thereby to block movement of the actuating lever to prevent actuation of the armature of the switch; and mounting means for mounting said control means to said actuating lever, said mounting means comprising pivot means for pivoting said control means about an axis substantially parallel to an operator engageable surface of said actuating lever to move said abutment surface away from said blocking means over the path of travel of said locking means.

2. An improvement as recited in claim 1, wherein said trigger means comprises a surface portion curved to match a contour of a finger thereby to facilitate engagement by the finger of the operator.

3. An improvement as recited in claim 1, wherein:

said blocking means comprises post means extending from the housing;

said cooperating means comprises extending means extending from said trigger means, a first surface of said extending means comprising said abutment surface; and further comprising biasing means for biasing said extending means extending from said trigger means to a position engaging said cooperating means wherein said abutment surface abuts against said post means;

whereby said actuating lever is blocked from actuating the armature of the switch.

4. An improvement as recited in claim 3, wherein:

said biasing means comprises spring means.

5. An improvement as recited in claim 3, wherein a second surface of said extending means comprises hook means for latching engagement with said post means, thereby retaining said actuating lever in latched actuation of the armature to provide electric current to the motor for driving the motor driven device.

6. An improvement as recited in claim 1, wherein said blocking means comprises mating means projecting from the housing for matingly engaging a surface of said cooperating means.

7. An improvement as recited in claim 6 wherein said mating means comprises a ribbed structure projecting from the housing for engaging said cooperating means.

8. An improvement as recited in claim 7 wherein said ribbed structure includes an angled surface for engaging said abutment surface of said cooperating means in a locked-off mode of operation.

9. An improvement as recited in claim 8 wherein said ribbed structure includes a further surface for engaging a second surface of said cooperating means in a locked-on mode of operation.

10. An improvement as recited in claim 6 wherein said mating means comprises post means.

11. In a switching apparatus for activating a driving motor of a motor driven device to operate the device, including a switch for selectively closing and breaking an electrical path to provide and remove electric current to and from the motor, respectively, and a manually operable power actuating lever, said actuating lever displaceable along a predetermined path to actuate an armature of the switch thereby to provide and remove the electric current, the improvement comprising:

trigger means displaceable, upon operation by an operator, along a path substantially parallel to the path of the actuating lever;

locking means for blocking movement of the actuating lever to prevent operation thereof unless said trigger means is displaced; and latching means for latching said actuating lever in a locked-on state wherein the armature of the switch is actuated to provide electric current to the motor without requiring the application of force on said actuating lever by an operator, said latching means being made effective upon release of said trigger means after actuation of said switch armature by said actuating lever and being released upon subsequent displacement of said trigger means by an operator.

12. An improvement as recited in claim 11, wherein said actuating lever is rotatably mounted for rotation about a first pivot axis, and said trigger means is pivoted for rotation about a second pivot axis substantially parallel to said first pivot axis.

13. An improvement as recited in claim 12, wherein said trigger means is mounted on the actuating lever.

14. An improvement as recited in claim 11 wherein said latching means comprises a hook-and-retainer assembly including hook means and retainer means, one of said hook means and said retainer means mounted fixedly relative to the armature of the switch, the other of said hook means and said retainer means mounted on the actuating lever, said one of said hook means and said retainer means mounted at a location wherein said actuating lever, when latched by said latching means, operates the armature of the switch.

15. An improvement as recited in claim 14 wherein said trigger means is mounted on the actuating lever, said hook means is mounted on said trigger means and said retainer means comprises post means extending from a housing for the switch.

16. An improvement as recited in claim 14 wherein said trigger means is mounted on the actuating lever, said hook means is mounted on said trigger means and said retainer means comprises a ribbed structure extending from a housing for the switch;

said ribbed structure including an angled surface for matingly engaging a surface of said hook means.

17. An improvement as recited in claim 14 wherein said trigger means is mounted on the actuating lever and said other of said hook means and said retainer means is mounted on said trigger means;

said locking means comprising abutting surfaces of said hook means and said retainer means cooperatively engaging to prevent movement of said actuating lever, thereby preventing operation of the armature of the switch, until operation of said trigger means.

18. An improvement as recited in claim 17 wherein said hook means is mounted on said trigger means, said hook means comprising a lever means extending from said trigger means, said trigger means pivotable about a pivot axis for displacing said hook means from abutment against said retainer means for permitting operation of said actuating lever to actuate the armature of the switch.

19. An improvement as recited in claim 18 wherein said retainer means comprises post means extending from a housing for the switch, said post means positioned for abutment against said lever means, said lever means having predetermined dimensions for preventing actuation of the armature by said actuating lever when abutting against said post means and for positioning said actuating lever to actuate the armature when latching said post means, thereby locking the motor driven device in an off state when said actuating lever is operated until operation of said trigger means, providing operation of the device when both said actuating lever and said trigger means are operated, latching operation of the device in an on state when said trigger means is released prior to release of the actuating lever, and providing for de-activation of the armature by operating said trigger means to unlatch said lever means from said post means.

* * * * *